US005724947A

United States Patent [19]

Takaki et al.

[11] Patent Number: 5,724,947

[45] Date of Patent: Mar. 10, 1998

[54] FUEL PUMP UNIT

[75] Inventors: Hiroshi Takaki; Yujiro Hayashi, both of Soja, Japan

[73] Assignee: OM Corporation, Okayama, Japan

[21] Appl. No.: 816,505

[22] Filed: Mar. 13, 1997

[51] Int. Cl.[6] ..... F02M 37/04

[52] U.S. Cl. ..... 123/509; 137/113; 137/565

[58] Field of Search ..... 123/509, 510, 123/514, 516, 198 D, 497; 137/113, 111, 399, 565, 572, 571, 574

[56] References Cited

U.S. PATENT DOCUMENTS

| | | | |
|---|---|---|---|
| 4,683,864 | 8/1987 | Bucci | 137/113 |
| 4,807,582 | 2/1989 | Tuckey | 137/113 |
| 4,971,017 | 11/1990 | Beakley | 123/509 |
| 4,974,570 | 12/1990 | Szwargulski . | |
| 5,050,567 | 9/1991 | Suzuki | 123/509 |
| 5,058,557 | 10/1991 | Frank | 137/565 |
| 5,363,827 | 11/1994 | Siekmann . | |
| 5,415,146 | 5/1995 | Tuckey . | |
| 5,642,719 | 7/1997 | Brown | 123/509 |

*Primary Examiner*—Carl S. Miller
*Attorney, Agent, or Firm*—Koda and Androlia

[57] ABSTRACT

In a fuel pump unit, to solve (1) the problem of a valve of a reserver opening unnecessarily due to vibrations from outside or the like and (2) the problem of it not being possible to supply to an engine remaining fuel having fallen to below a minimum intake level, a main tank valve and a reserve valve respectively close from above a main fuel inlet connecting with a fuel intake passage of the fuel pump unit and an auxiliary fuel inlet connecting with the fuel intake passage and a rocking member having a force point pivotally attached to the main tank valve and having the action of pushing up the reserve valve with an action point and thereby opening the auxiliary fuel inlet when the main tank valve closes the main fuel inlet is provided and a sub-float for descending and pushing down the reserve valve from above when excess fuel in the reserver runs out is disposed in the reserver.

2 Claims, 3 Drawing Sheets

FUEL PUMP UNIT

BACKGROUND OF THE INVENTION

1. Field of the Invention

This invention relates to a fuel pump unit for supplying fuel from a fuel tank, for example a car fuel tank, to an engine, and particularly to a switching mechanism for switching between a main tank and a reserver of the fuel tank.

2. Prior Art

There have been various means for supplying fuel from a fuel tank, for example a car fuel tank, to an engine, and one of these is the fuel pump unit. In recent years, to extend the driving time of an engine, fuel tanks have come to have a reserver (or sub-tank) in addition to a main tank, and such fuel tanks are normally provided with a switching mechanism for switching a fuel intake passage of the fuel pump unit between the main tank and the reserver (hereinafter abbreviated to switching mechanism). The reserver holds excess fuel returned from the engine, and when the supply of fuel from the main tank runs out the switching mechanism closes a main fuel inlet connecting with the main tank, which had been connected to the fuel intake passage, and opens and thereby connects to the fuel intake passage an auxiliary fuel inlet, which until then had been closed, connecting with the reserver. In this way, it is possible to drive the engine for a while longer when normally the fuel would have run out.

Although among fuel pump units having a switching mechanism there have been those wherein a diaphragm control valve is used, as shown in U.S. Pat. No. 5,415,146, those employing a switching mechanism using a valve opened and closed by a float rising and falling in correspondence with remaining fuel inside the main tank, as shown in U.S. Pat. No. 4,974,570 and U.S. Pat. No. 5,363,827, have been more common. This is because the construction of a switching mechanism using a valve opened and closed by a float is simple.

In the related art examples mentioned above (U.S. Pat. No. 4,974,570 and U.S. Pat. No. 5,363,827), a main fuel inlet is disposed at the bottom a fuel intake passage of the fuel pump unit and an auxiliary fuel inlet is disposed at the top of the fuel intake passage facing the main fuel inlet in the vertical direction, and one common valve or interconnected separate main tank and reserve valves moving in a straight line in the vertical direction are connected to a float. That is, when one of the fuel inlet openings is closed the other opens, and the selection of whether the main fuel inlet is closed or the auxiliary fuel inlet is closed is carried out according to ascent and descent of the float. To effect this, the construction is such that the reserve valve closes the auxiliary fuel inlet from below.

When a construction wherein the reserve valve closes the auxiliary fuel inlet from below is used, the following problems may arise. Because when the amount of remaining fuel in the main tank has become small and the level of the remaining fuel has fallen below a predetermined level (this will be called the minimum intake level) the reserve valve must be opened by the descending float, this reserve valve cannot be pressed strongly against its valve seat. Consequently, a first problem is that there is a danger of the valve being opened undesirably by vibrations from outside such as, for example in the case of a car, vibrations during travel of the car. If the reserve valve opens in this way, when the reserver is switched to from the main tank there is not the amount of excess fuel in the reserver specified by design values, and this is not desirable.

Also, as a second problem, in the switching mechanism described above, if the float does not rise then the main tank valve does not open and even if there is sufficient remaining fuel in the main tank for some to be supplied to the engine, fuel cannot be supplied to the engine. This is because to allow the float to rise it is necessary to make the minimum intake level higher than when no reserver is provided, and the greater the amount of this non-usable remaining fuel is the larger the fuel tank must be made to provide a given capacity specified by design values.

In this connection, in order to solve the two problems described above, the present inventors studied the linkage relationship between the float and the valves in a fuel pump unit having a switching mechanism for switching between a main tank and a reserver wherein a common valve or interconnected main tank and reserve valves are moved by a float ascending and descending in correspondence with the level of remaining fuel in the main tank.

SUMMARY OF THE INVENTION

It is therefore an object of the invention to provide a fuel pump unit of which the reserver valve does not open unnecessarily due to vibrations from outside or the like and furthermore which can supply fuel to an engine even when the remaining fuel has fallen to below a minimum intake level.

To achieve this object and other objects, the invention provides a fuel pump unit having a switching mechanism for switching between a main tank and a reserver and comprising a main tank valve linked to a float rising and falling in proportion with the level of remaining fuel inside a main tank of a fuel tank and a reserve valve opening and closing in linkage with this main tank valve, wherein the main tank valve and the reserve valve respectively close from above a valve seat a main fuel inlet connecting with a fuel intake passage of the fuel pump unit and an auxiliary fuel inlet connecting with the fuel intake passage and a rocking member having a force point pivotally attached to the main tank valve for pushing up the reserve valve with an action point and thereby opening the auxiliary fuel inlet when the main tank valve closes the main fuel inlet is disposed with a support point between the main tank valve and the reserve valve.

In the invention, firstly, as a result of the reserve valve being made to close the auxiliary fuel inlet from above its valve seat, as long as there is excess fuel in the reserver the reserve valve is pushed onto the auxiliary fuel inlet by the liquid pressure of this excess fuel and consequently the reserve valve is not easily opened even by vibrations of for example during travel of a car in which the fuel pump unit is installed. As a result, because unlike in the related art the main tank valve and the reserve valve move in the same directions to open and close their respective fuel inlet openings, the direction of movement of the main tank valve is inverted by the rocking member and the movements of the two valves are given a complementary relationship such that when the main tank valve opens the reserve valve closes and when the main tank valve closes the reserve valve opens.

To achieve this the rocking member has its force point pivotally attached to the main tank valve and is rocked by the main tank valve moving up and down in correspondence with the float rising and falling in correspondence with remaining fuel in the main tank. When the main tank valve closes, i.e. moves downward, the action point of the rocking member is relatively lifted and pushes up the reserve valve from below and opens the auxiliary fuel inlet. Since the purpose of the rocking member is to invert and transmit to the reserve valve the movement of the main tank valve, it is sufficient if its force point is pivotally attached to the main tank valve, and its action point does not necessarily have to be connected (for example pivotally attached) to the reserve valve.

When there is sufficient remaining fuel in the main tank, because the float rises the main tank valve moves upward and opens the main fuel inlet, and as a result of the action point of the rocking member descending the reserve valve ceases to be pushed upward from below and moves downward under the liquid pressure of the excess fuel in the reserver and closes the auxiliary fuel inlet.

When the amount of remaining fuel in the main tank becomes so small that the level of the remaining fuel falls below the minimum intake level, the main tank valve is moved downward by the descending float and closes the main fuel inlet, the action point of the rocking member rises and pushes up the reserve valve from below and consequently the reserve valve moves upward and opens the auxiliary fuel inlet.

Secondly, in the fuel pump unit of the invention described above, a sub-float for descending and pushing down the reserve valve from above when excess fuel in the reserver runs out is disposed in the reserver. As is clear from the description above, the main tank valve opens when either there is sufficient remaining fuel in the main tank and the float rises or when the reserve valve moves downward and pushes on the action point of the rocking member from above and thereby relatively lifts the force point of the rocking member.

However, when the amount of remaining fuel in the main tank has become so small that it has fallen below the minimum intake level and the reserve valve has opened and the excess fuel in the reserver has been used up, naturally the float does not rise, and also if the weight of the reserve valve itself is not enough to rock the rocking member pivotally attached to the main tank valve then the reserve valve cannot be expected to move downward and the remaining fuel in the main tank cannot be used and remains unused. To avoid this, a sub-float is disposed inside the reserver and when the excess fuel runs out the sub-float descends and forcibly closes the reserve valve and the action point of the rocking member is thereby pushed downward and relatively lifts the force point and opens the main tank valve so that even remaining fuel having fallen below the minimum intake level can be drawn through the main fuel inlet into the fuel intake passage.

DETAILED DESCRIPTION OF THE PREFERRED EMBODIMENTS

Figure 1:
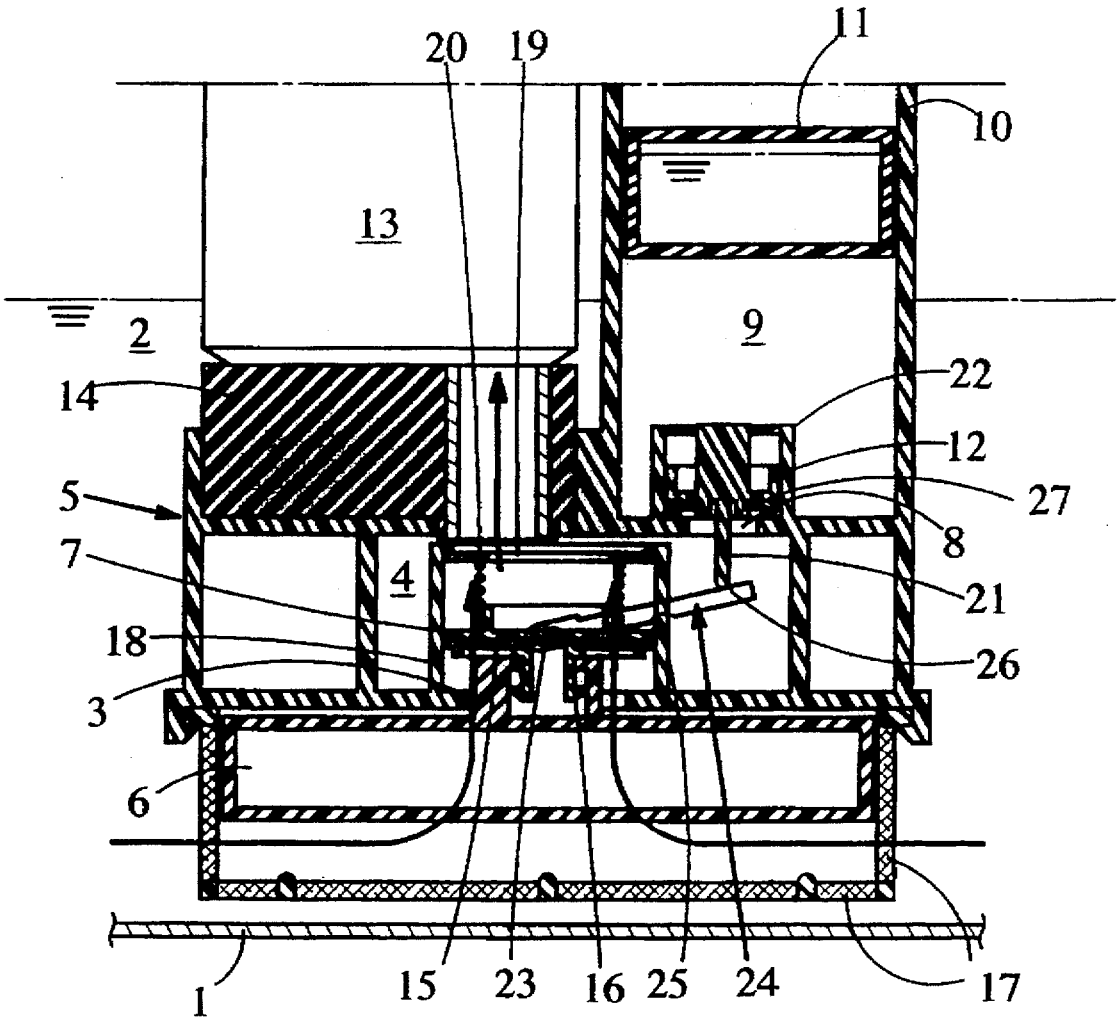
FIG. 1 is a sectional view of a fuel pump unit showing remaining fuel being taken in through a main fuel inlet.

A preferred embodiment of the invention will now be described in detail with reference to the accompanying drawings. FIG. 1 is a sectional view of a fuel pump unit 5 according to the invention showing a state wherein there is ample remaining fuel 2 in a main tank 1 and remaining fuel 2 is being drawn into a fuel intake passage 4 through a main fuel inlet 3.

Referring to FIG. 1, the construction of this fuel pump unit 5 will now be described. The fuel pump unit 5 is mounted integrally with a reserver 10 on a pump 13 for pumping remaining fuel 2 from the main tank 1 or excess fuel 9 from the reserver 10 to an engine (not shown), and connects the fuel intake passage 4 to the pump 13 by way of a rubber packing 14. A main tank valve 7 for closing the main fuel inlet 3, which is provided in the bottom of the fuel intake passage 4, from above a valve seat thereof is a resin disc disposed substantially in the middle of the inside of the fuel intake passage 4, and a rubber packing 15 for sealing is affixed to the underside of the resin disc. A float 6 able to move up and down inside a mesh filter 17 in proportion with the level of the remaining fuel 2 is interlocked with an engaging piece 16 projecting from the underside of the main tank valve 7. In this example, a coil spring 20 is interposed between the main tank valve 7 and an opposing annular plate 19 fixed to the upper edge of a main tank valve track frame 18, and by the float 6 and the main tank valve 7 being linked together with a fixed degree of freedom in the vertical direction, when the level of the remaining fuel 2 is relatively high, vertical oscillation of the float 6 does not affect the opening and closing of the main tank valve 7.

A reserve valve 12 for closing an auxiliary fuel inlet 8 provided in the top of the fuel intake passage 4 from above its valve seat as in the case of the main valve has a pushing projection 21 projecting downward from the auxiliary fuel inlet 8 for pushing a rocking member 24 and like the main tank valve 7 has a rubber packing 27 affixed to its underside and moves up and down inside a reserve valve track frame 22. The rocking member 24, which has a force point 23 pivotally attached to the middle of the main tank valve 7, is a lever which has a support point 25 on the main valve track frame 18 and with an action point 26 presses the pushing projection 21 upward from below and pushes open the reserve valve 12. A sub-float 11 disposed inside the reserver 10 rises and falls in proportion with the level of excess fuel 9 in the reserver 10, and when it falls the sub-float 11 reversely pushes down the action point 26 by pushing the reserve valve 12 downward and opens the main tank valve 7 by relatively lifting the force point 23.

When there is ample remaining fuel 2 in the main tank 1, as shown in FIG. 1, the float 6 rises inside the mesh filter 17 and opens the main tank valve 7. The remaining fuel 2 inside the fuel tank passes through the mesh filter 17 and is drawn through the main fuel inlet 3 and the fuel intake passage 4 into the pump 13 and supplied to the engine (not shown). Also, because the action point 26 relatively lowered by the force point 23 of the rocking member 24 being lifted as a result of the main tank valve 7 moving upward moves away from the pushing projection 21 of the reserve valve 12, the reserve valve 12 is pushed down by excess fuel 9 when there is ample excess fuel 9 inside the reserver 10 and by the lowered sub-float 11 when there is no excess fuel 9 and closes the auxiliary fuel inlet 8.

Figure 2:
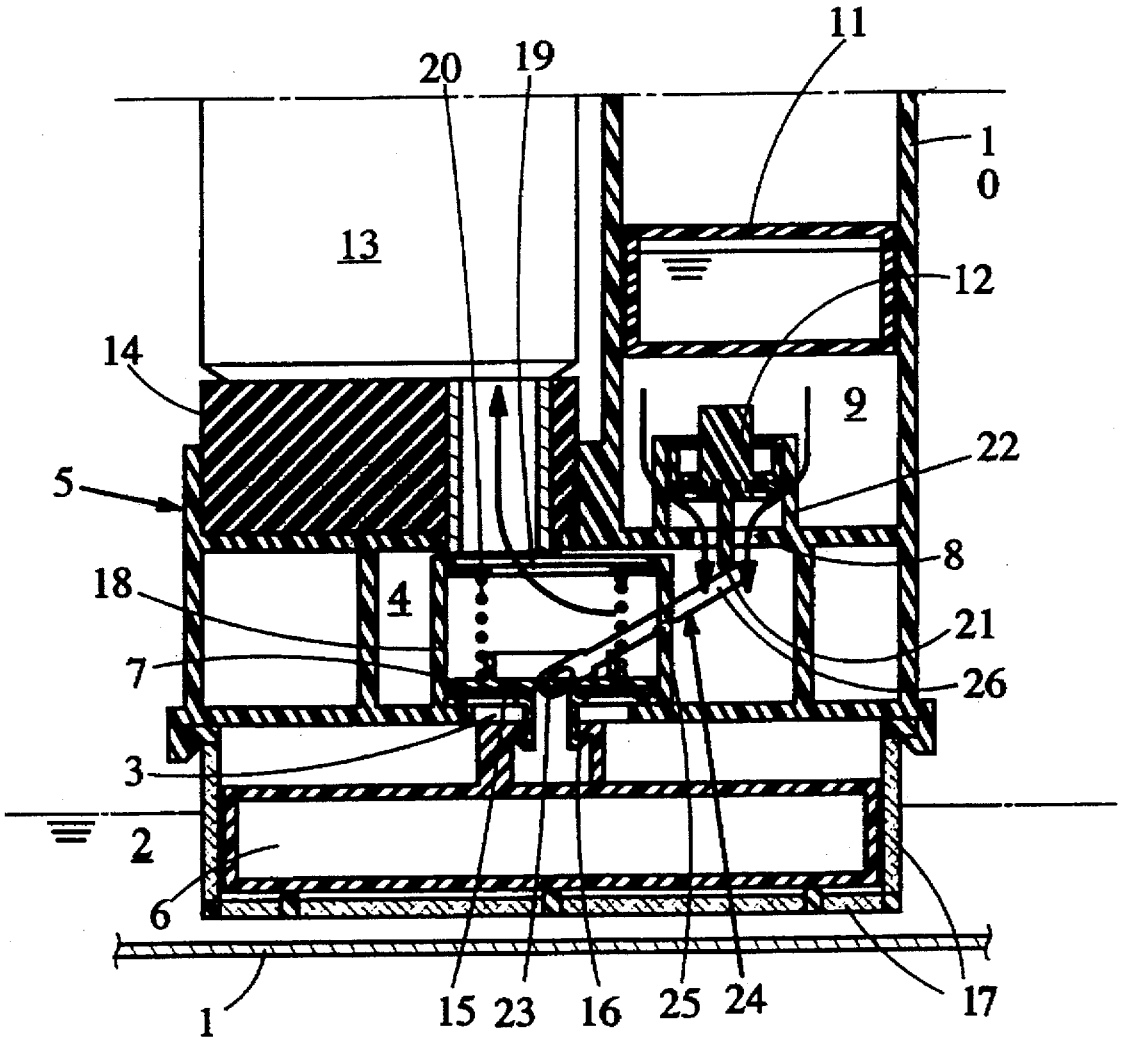
FIG. 2 is a sectional view of the same fuel pump unit showing excess fuel being taken in through an auxiliary fuel inlet.

FIG. 2 is a sectional view of the same fuel pump unit 5 showing a state wherein the remaining fuel 2 in the main tank 1 has fallen below a minimum intake level and as a result of the float 6 falling the main tank valve 7 has closed the main fuel inlet 3 and excess fuel 9 is being drawn into the fuel intake passage 4 through the auxiliary fuel inlet 8 opened instead.

When the remaining fuel 2 in the main tank 1 falls to below a minimum intake level, as shown in FIG. 2, the float 6 descends and the main tank valve 7 closes the main fuel inlet 3. Then, along with the downward movement of the main tank valve 7, the force point 23 of the rocking member 24 is lowered and its action point 26 is lifted and pushes the pushing projection 21 upward from below and moves the reserve valve 12 upward and thereby opens the auxiliary fuel inlet 8.

Figure 3:
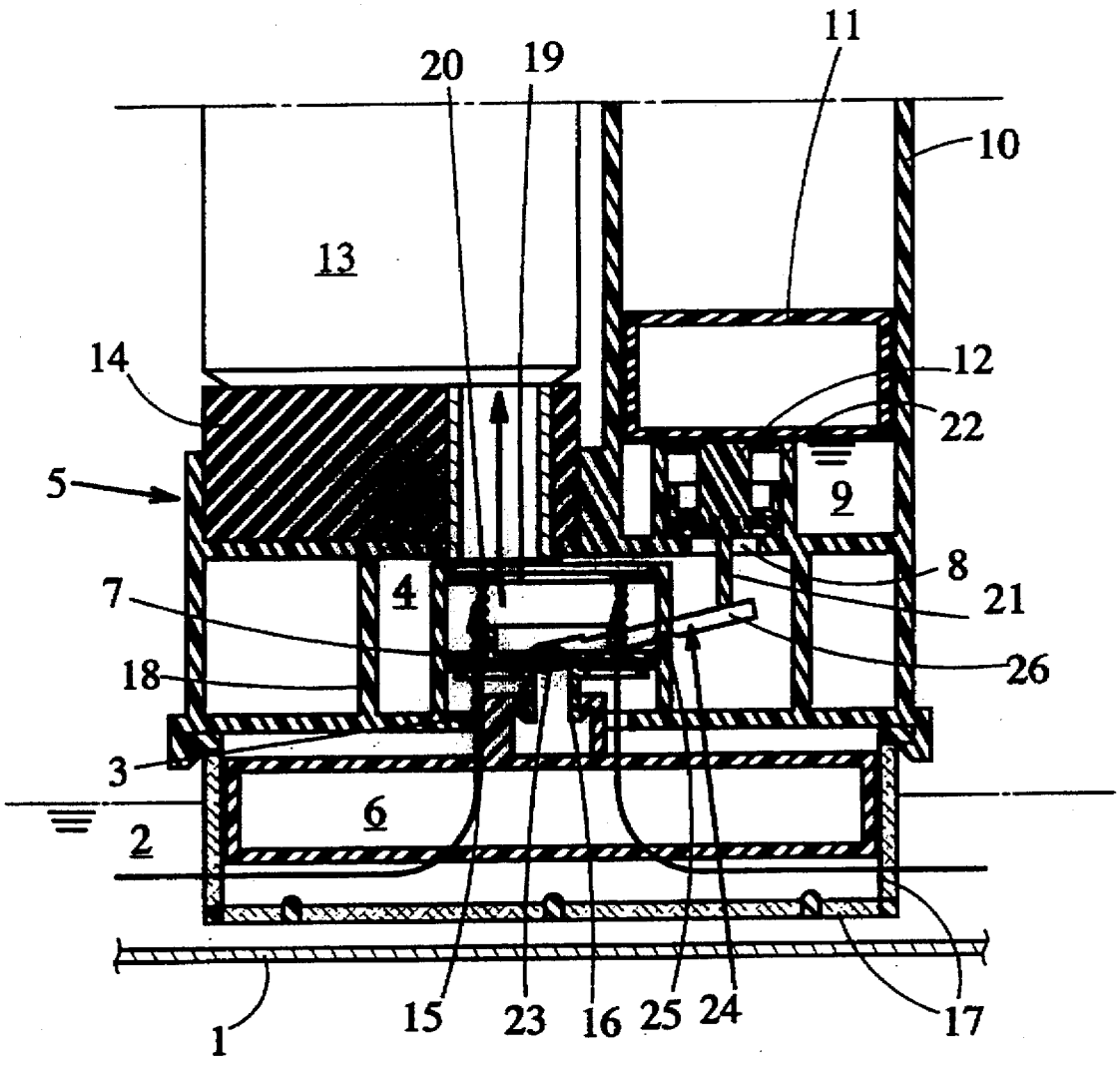
FIG. 3 is a sectional view of the same fuel pump unit showing remaining fuel having dropped below a minimum level for intake being taken in through the main fuel inlet.

FIG. 3 is a sectional view of the same fuel pump unit 5 showing a state wherein the excess fuel 9 inside the reserver 10 has run out and the sub-float 11 has descended whereby the reserve valve 12 has closed the auxiliary fuel inlet 8 and instead the main tank valve 7 has opened the main fuel inlet 3 and remaining fuel 2 having fallen below the minimum intake level is being drawn into the fuel intake passage 4.

When most of the excess fuel 9 inside the reserver 10 has been drawn as shown in FIG. 2 through the auxiliary fuel inlet 8 and the fuel intake passage 4 into the pump 13, as shown in FIG. 3 the sub-float 11 descends and pushes down the reserve valve 12 from above and the reserve valve 12 moves downward and closes the auxiliary fuel inlet 8. When this happens, this time, in the reverse of the relationship described above, the pushing projection 21 of the reserve valve 12 pushes down the action point 26 of the rocking member 24 and relatively lifts the force point 23 and the main tank valve 7 is thereby lifted together with the float 6, opening the main tank valve 7. Thus, even when there is little remaining fuel in the main tank 1 and the float 6 has descended and the main tank valve 7 has closed the main fuel inlet 3, remaining fuel 2 having fallen below the minimum intake level is still present in the main tank 1, and remaining fuel 2 having fallen below the minimum intake level is again drawn through the main fuel inlet 3 opened by the operation described above and sent through the pump 13 to the engine (not shown).

At this time, when the parts of the mesh filter 17 at the sides of the fuel pump unit 5 are thoroughly wet with fuel liquid, air does not readily pass through them and drawing of remaining fuel is carried out, but when they are dry, air passes through them and satisfactory drawing of remaining fuel is not carried out. To overcome this, if a wall covering upper parts of the side faces of the mesh filter 17 is suspended from the fuel pump unit 5 proper, even if air passes through the upper parts of the side faces of the mesh filter 17, because this wall is present, remaining fuel 2 is more strongly sucked into the fuel pump unit 5.

In a fuel pump unit of the invention, as a result of it having the construction described above, the problem of the main tank valve and the reserve valve, which open and close while moving in a complementary relationship, opening and closing unexpectedly due to vibrations from outside or the like is solved. As a result, it is possible to provide excess fuel collected in the reserver in accordance with design values and make the functioning of the reserver as a reserver complete, numerical values of excess fuel available in the reserver can be included as a reliable specification for example in catalogs and the like, and it is thereby possible to raise the product value of a car.

Also, when the excess fuel in the reserver has run out, because the reserve valve is closed by being pushed down from above by the descending sub-float, the main tank valve can be opened irrespective of rising and falling of the float and even remaining fuel having fallen below the minimum intake level can be delivered to the engine. This is desirable because it enables a minimum amount of fuel to be put into the fuel tank for example when a car in which the fuel pump unit is installed comes off a production line so that when the new car is transported by being driven, most of this fuel can be effectively used.

Furthermore, the sealing of the reserve valve with respect to the auxiliary fuel inlet is improved by the pushing of the sub-float and urging of the reserve valve by means of a spring becomes unnecessary and a reduction in the number of parts and simplification of the construction can therefore be achieved, the reserve valve can be made light and its opening and closing response can thereby be raised, and it is possible to raise the reliability of operation of the fuel pump unit as a mechanism for switching between the main tank and the reserver.

What is claimed is:

1. A fuel pump unit having a switching mechanism for switching between a main tank and a reserver, the switching mechanism comprising a main tank valve linked to a float rising and falling in proportion with the level of remaining fuel inside a main tank of a fuel tank and a reserve valve opening and closing in linkage with the main tank valve, wherein the main tank valve closes a valve seat therefor provided near a main fuel inlet communicating with a fuel intake passage of the fuel pump unit, the reserve valve closes a valve seat therefor provided near an auxiliary fuel inlet communicating with the fuel intake passage, and a rocking member is disposed with a support point thereof located between the main tank valve and the reserve valve, the rocking member having a force point pivotally attached to the main tank valve for pushing up the reserve valve with an action point thereof when the main tank valve closes the main fuel inlet, thereby opening the auxiliary fuel inlet.

2. A fuel pump unit according to claim 1, wherein a sub-float for descending and pushing down the reserve valve from above when excess fuel in the reserver runs out is disposed in the reserver.

* * * * *